United States Patent [19]

Joost

[11] Patent Number: 4,537,544

[45] Date of Patent: Aug. 27, 1985

[54] METHOD OF FORMING A FOLDER FOR REPORTS OR STATEMENTS OF ACCOUNT AND COVER TO EFFECT THE METHOD

[76] Inventor: Friedrich Joost, DK 8900 Randers, Denmark

[21] Appl. No.: 471,492

[22] Filed: Mar. 2, 1983

[51] Int. Cl.[3] ..... B42D 1/00

[52] U.S. Cl. ..... 412/5; 421/4; 421/901; 493/385

[58] Field of Search ..... 412/900, 901, 4, 5; 493/385

[56] References Cited

U.S. PATENT DOCUMENTS 3,749,423 7/1973 Abildgaard et al. ..... 412/5

4,289,330 9/1981 Wiermanski ..... 412/900

4,422,672 12/1983 Levi ..... 412/901

*Primary Examiner*—W. D. Bray

*Attorney, Agent, or Firm*—Leonard Bloom

[57] ABSTRACT

A method of forming a folder of documents and a folder for putting the method into effect. The folder has folds or creases defining a spine between a front and a back cover of the folder, and side folds spaced from the spine folds. An adhesive strip covered with a protective film is applied to the interior of the folder along the spine in a region delimited by the side folds. In use the protective film is removed, a sheaf of documents, preferably stapled together, is permanently secured in the folder so that documents cannot be removed without detection.

4 Claims, 3 Drawing Figures

METHOD OF FORMING A FOLDER FOR REPORTS OR STATEMENTS OF ACCOUNT AND COVER TO EFFECT THE METHOD

The present invention deals with a method of forming a folder for reports or statements of account and a cover to effect the method.

Folders are existing which have two spine edges placed at an interval similar to the thickness of the completed folder. The sheets are inserted in the cover and are assembled by means of stapling. The existing folders can be disassembled and sheets can be conveniently removed from the folder whereupon the folder can be assembled again, which is a disadvantage.

There are also folders whose covers on the inside have a flexible, pre-bent metallic strip to be led through two holes in the sheets and bent back onto the top side of the sheaf. With this procedure report sheets can be unnoticeably removed, too.

Additional to the folders already mentioned there are folders in which the sheets are assembled by hanging up the sheaf vertically and immersing the bottom part in a tub with glue. The glued sheaf is inserted in a cover and sheaf and cover are stapled.

From these folders it is impossible to conveniently remove sheets. Moreover, these folders are difficult and time-consuming to form.

The intention of the present invention is to show a method of forming a folder without all these disadvantages. By designing the cover as stated in accordance with the invention, ready-made covers can be forwarded in cartons, can be stored over a long period ready for use. Furthermore the folder can be made by the user witout special technical knowledge. The side edges have the effect (1) that the range in which glue is applied when the cover is made, are clearly delimited, and (2) that the glue is not overloaded in the completed folder, and (3) that the sheets can be bent about a sharp, pre-bent edge. As there are two side edges both sides of the cover can be used as front when being printed.

Moreover, the invention discloses an especially simple way of applying the glue to the cover. The glue strip may be inserted before the printing of the cover which may be an advantage during the process of manufacture.

The invention will be described below with reference to the drawing on which

Figure 1:
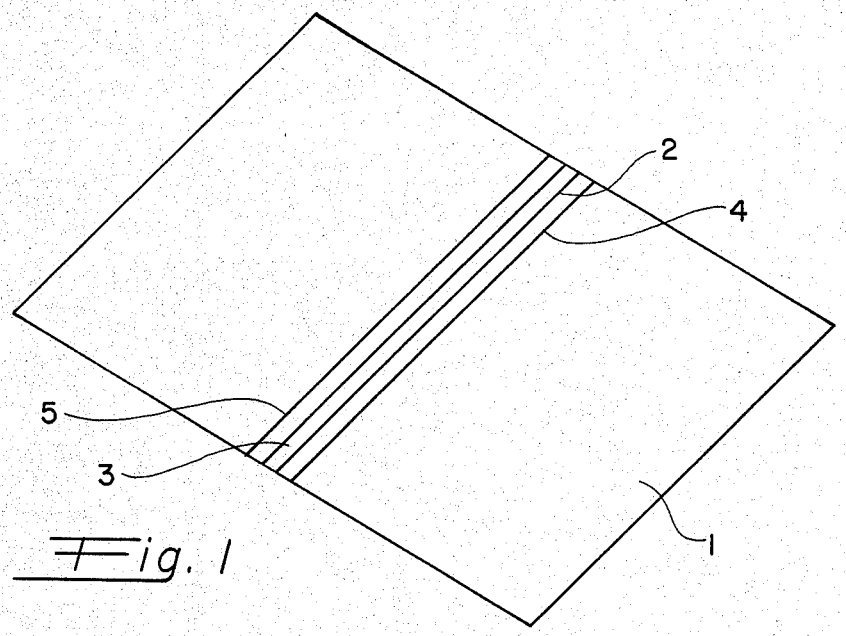
FIG. 1 is a schematical perspective drawing of a cover for a folder, in accordance with the invention, open.

As shown in FIG. 1 a cover 1 for a folder in accordance with the invention has two spine edges 2,3 and two sided edges 4,5.

The spine edges and the side edges are placed symmetrically about the centre line of the cover. The cover may be made of carton, plastic or other suitable material. Text can be transferred to the cover by printing.

Figure 2:
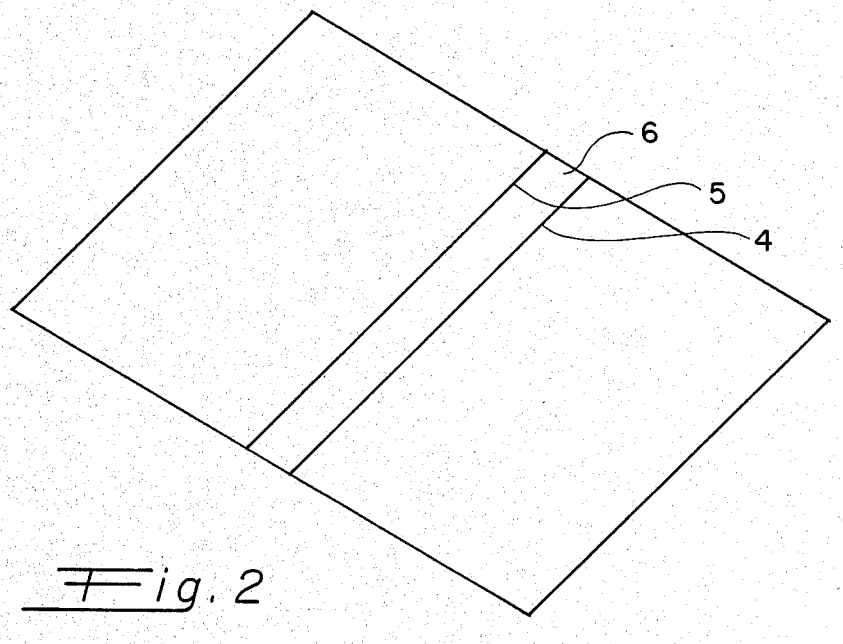
FIG. 2 is a cover like FIG. 1 but with inserted two-sided glue strip.

As shown in FIG. 2 glue can be applied to the range between the two side edges 4,5 by gluing on a two-sided glue strip 6 with cover foil. The glue strip has the same width as the interval between the side edges.

Figure 3:
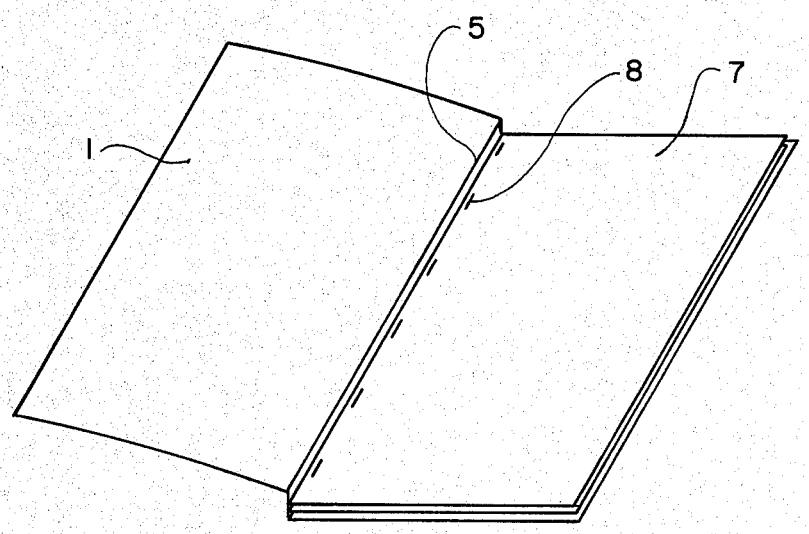
FIG. 3 is a perspective drawing of a nearly completed folder in accordance with the invention.

As shown in FIG. 3 the folder is assembled for example by stapling 8 the report sheets 7 along the spine edge. Then the cover foil is removed from the glue strip 6 and the sheaf 7 is inserted in the cover so that the rear edge is in line with the spine edge 2. The underside is glued on by pressing the sheaf against the cover. Then the cover is folded about the spine edge 2 and the sheaf is glued on along the spine. The cover is eventually folded about the spine edge 3 and the top side in the report is glued on the cover front.

When the report is to be read, it is opened. The cover is folded along the side edge 5 which forms a rigid band by folding all sheets in the report.

I claim:

1. A folder for documents comprising a sheet of thin, flexible material having first and second parallel spine folds or creases to define a first cover, a spine area, and a second cover; a side fold or crease in the first cover of the folder, said side fold or crease being adjacent and parallel to said first spine fold; a double-sided adhesive covering the area defined by the side fold in said first cover and a region in the second cover adjacent and parallel to the second spine fold and extending into said second cover approximately the same distance as said side fold from said first spine fold; and a removable protective film covering said double-sided adhesive.

2. A folder for documents comprising a sheet of thin, flexible material having first and second parallel spine folds or creases to define a first cover, a spine area, and a second cover; a first side fold or crease in the first cover of the folder, said first side fold or crease being adjacent and parallel to said first spine fold; a second side fold or crease in the second cover of the folder, said second side fold or crease being adjacent and parallel to said second spine fold; a double-sided adhesive covering the area defined by the first side fold and the second side fold; and a removable protective film covering said double-sided adhesive.

3. A method of forming a folder of documents comprising the steps of:

a. securing a sheaf of documents along the spine edge thereof;

b. inserting the sheaf of documents into a folder which comprises a sheet of thin, flexible material having first and second parallel spine folds or creases which define a first cover, a spine area, and a second cover; a side fold or crease in the first cover of the folder, said side fold or crease being adjacent and parallel to said first spine fold; a double-sided adhesive covering the area defined by the side fold in said first cover and a region in the second cover adjacent and parallel to the second spine fold and extending into said second cover approximately the same distance as said side fold from said first spine fold; the spine edge of said sheaf of documents being in line with and in contact with the spine area of said folder;

c. folding said folder over said sheaf of documents, and d. pressing the outside of the folder in the area covered by the double-sided adhesive whereby the sheaf of documents is securely bound therein.

4. A method of forming a folder of documents comprising the steps of:

a. securing a sheaf of documents along the spine edge thereof;

b. inserting the sheaf of documents into a folder which comprises a sheet of thin, flexible material having first and second parallel spine folds or creases to define a first cover, a spine area, and a second cover; a first side fold or crease in the first cover of the folder, said first side fold or crease being adjacent and parallel to said first spine fold; a second side fold or crease in the second cover of the folder, said second side fold or crease being adjacent and parallel to said second spine fold; a double-sided adhesive covering the area defined by the first side fold and the second side fold; the spine edge of said sheaf of documents being in line with and in contact with the spine area of said folder;

c. folding said folder over said sheaf of documents, and d. pressing the outside of the folder in the area covered by the double-sided adhesive whereby the sheaf of documents is securely bound therein.

* * * * *